US005691714A

United States Patent [19]

Mehnert et al.

[11] Patent Number: 5,691,714

[45] Date of Patent: Nov. 25, 1997

[54] PROCESS FOR THE SERIAL TRANSMISSION OF DIGITAL MEASUREMENT VALUES

[76] Inventors: Walter Mehnert, Grillparzer Strasse 6, 85521 Ottobrunn; Thomas Theil, Alte-Traubinger-Strasse 5, 82340 Feldafing, both of Germany

[21] Appl. No.: 570,209

[22] Filed: Dec. 11, 1995

[30] Foreign Application Priority Data

Dec. 9, 1994 [DE] Germany ..... 44 43 959.8

[51] Int. Cl.[6] ..... G08C 19/06

[52] U.S. Cl. ..... 340/870.05; 340/870.01; 340/870.07; 340/870.18; 340/825.33; 375/244; 375/243; 375/260; 341/143

[58] Field of Search ..... 340/870.01, 870.04, 340/870.05, 825, 23, 870.07, 870.18; 375/28, 27, 244, 243, 260; 341/143

[56] References Cited

U.S. PATENT DOCUMENTS

| | | | |
|---|---|---|---|
| 3,114,900 | 12/1963 | Anderson | 340/870.05 |
| 3,686,631 | 8/1972 | Elliott | 340/870.23 |
| 3,851,302 | 11/1974 | Schmidt | 340/870.23 |
| 4,559,520 | 12/1985 | Johnston . | |
| 4,759,038 | 7/1988 | Takahashi et al. . | |
| 5,465,270 | 11/1995 | Beauducel | 340/870.04 |

FOREIGN PATENT DOCUMENTS

| | | |
|---|---|---|
| 2377611 | 8/1978 | France . |
| 3049000 | 9/1982 | Germany . |
| 2136583 | 9/1984 | Germany . |
| 3410752 | 9/1985 | Germany . |
| 3822941 | 1/1989 | Germany . |

OTHER PUBLICATIONS

Mausl R: "Modulationsverfahren zur Ubertagung von Signalen (V)", de/der Elektromeister+Deutsches Elektrohandwerk 1984, No. 21, pp. 1615–1618.

*Primary Examiner*—Jeffery Hofsass
*Assistant Examiner*—Albert K. Wong
*Attorney, Agent, or Firm*—Sughrue, Mion, Zinn, Macpeak & Seas, PLLC

[57] ABSTRACT

In a process for the serial transmission of measurement values which are continuously supplied by a sensor and which occur at the transmitter end in digital form, to a receiver, the measurement values are ascertained at such short time intervals that their deviation from the respectively precedingly ascertained measurement value can he represented generally by only two bits of which the one reproduces the sign and the other the value of the deviation. Of the measurement values which occur within a predeterminable period of time, only a respective one is completely transmitted as an absolute value while of the others only the respective incremental alteration values which are related to the one measurement value are transmitted. At the receiver end 'virtual' measurement values corresponding to the measurement values occurring at the transmitter end are synthesised by the transmitted incremental values being added, correctly in respect of value and sign, to the completely transmitted absolute value.

20 Claims, 1 Drawing Sheet

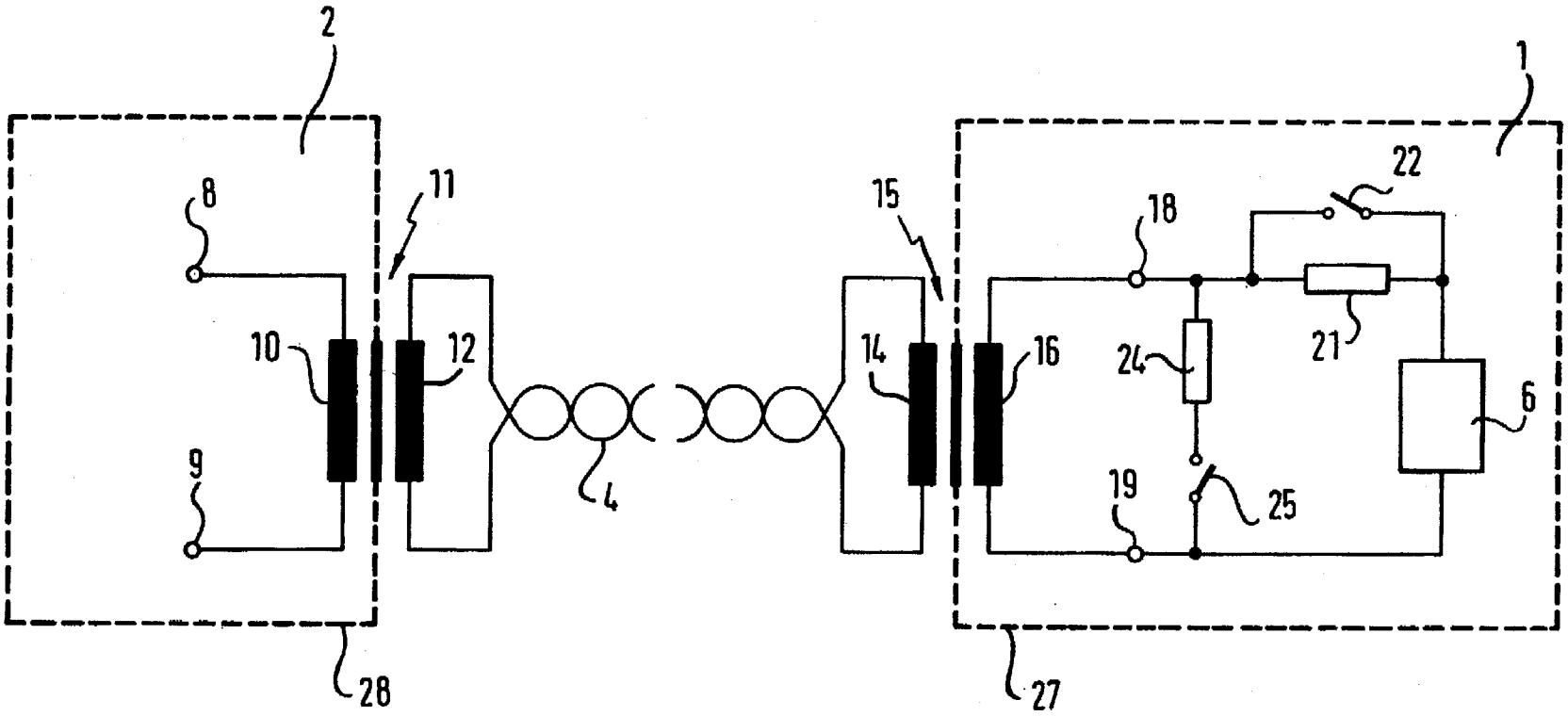
1
6
22
21
25
18
24
19
16
27
15
14
4
11
12
2
28
10
8
9

PROCESS FOR THE SERIAL TRANSMISSION OF DIGITAL MEASUREMENT VALUES

FIELD OF THE INVENTION

The invention generally concerns a process for the serial transmission of measurement values which are continuously supplied by a sensor and which occur at the transmitter end in digital form, to a receiver.

BACKGROUND OF THE INVENTION

Processes of the general kind to which the invention relates are used for example when measurement values are to be continuously transmitted from a peripherally disposed sensor to a central evaluation and processing unit which functions as a user. In accordance with the present procedures that involves the problem that the transmission rate falls in proportion to the degree of accuracy or the resolution capability with which the measurement values are obtained and transmitted as a high degree of accuracy or a high resolution capability make it necessary to have a high number of bits for each respective measurement value.

If that number of bits for each measurement value comes into an order of magnitude of twelve or more bits, then the procedure which is frequently adopted is parallel transmission. However, parallel transmission suffers from the disadvantage that it requires a large number of parallel transmission lines, which are difficult to screen, with a correspondingly large number of transmission and reception units. The disadvantage of parallel data transmission is particularly apparent when the transmission lines must be provided in a potential-free condition.

SUMMARY OF THE INVENTION

An object of the present invention is to develop a process for the serial transmission of measurement values such that the advantage inherent in a serial transmission procedure of a low number of transmission lines is retained while at the same time the transmission rate achieved is not only comparable to but even exceeds the transmission rates of parallel transmission procedures.

Another object of the present invention is to provide a process for the serial transmission of measurement values which occur in digital form to a receiver, which involves a simple operating procedure while affording a highly satisfactory resolution capability and transmission rate.

In accordance with the present invention the foregoing and other objects are attained by a process for the serial transmission of measurement values which are continuously supplied for example by a sensor and which occur at the transmitter end in digital form, to a receiver. The measurement values are ascertained at such short time intervals that their deviation from the respectively precedingly ascertained measurement value is generally either +1, 0 or −1 and can thus be represented by only two bits of which one reproduces the sign and the other the value of the deviation. Of the measurement values occurring within a predeterminable period of time, only a respective one is completely transmitted as an absolute value while of the others, only the respective incremental alteration values which are related to said one measurement value are transmitted. At the receiver end, 'virtual' measurement values corresponding to the measurement values occurring at the transmitter end are synthesised by a procedure whereby the transmitted incremental values are added, correctly in respect of value and sign, to the completely transmitted absolute value.

As will be seen from the following description of a preferred embodiment of the invention, the process of the invention is based on sensor systems which deliver continuously in a cycle which is predetermined by the sensor system, measurement values which occur either only as absolute values or both as absolute values and also as incremental alteration values.

Transmission values are formed from those measurement values, the transmission values being attributed to two categories in regard to their information content.

The transmission values in the first category are transmitted as absolute values, that is to say, all bits which represent the respectively associated absolute measurement value are progressively fed at the transmitter end into the transmission line by means of a suitable modulation procedure, and, at the receiver era, they are assembled to give a received measurement value, having regard to the place value which is attributed to each of those bits; the received composite measurement value is both put into intermediate storage and also passed to means for further processing thereof.

In contrast the transmission values in the second category are only ever formed by a sign bit and a value bit so that they respectively represent the incremental alteration value in respect of the preceding measurement value.

In the case of sensor systems which, besides the absolute measurement values, also supply the incremental values, the latter can be used directly as transmission values in the second category. If the sensor system only affords absolute values, the transmission values in the second category are obtained at the transmitter end by forming the difference between the successive absolute values.

As soon as a transmission value in the first category has completely arrived at the receiver, a 'virtual' absolute measurement value can be produced at the receiver end for each of the absolute measurement values which are subsequently produced by the sensor but of which only the incremental alteration value is transmitted; the 'virtual' absolute measurement value is produced by a procedure whereby the subsequent increments are added with the correct sign to the completely transmitted absolute value, that is to say, in the case of a positive sign they are added and in the case of a negative sign they are subtracted. The increment of the value zero does not result in any alteration in the virtual measurement value which is formed at the receiver end. The increment can thus be represented by means of two bits, insofar as for example the bit sequence 01 is associated with the alteration −1, the bit sequence 10 is associated with the alteration +1 and the bit sequence 11 is associated with the 'alteration' 0. The bit sequence 00 which is also possible either remains unused, in which case the appearance thereof can be taken as an indication that an error has occurred, or it serves for example to identify subsequent bits as protocol bits.

The maximum rate of alteration, which occurs under any circumstances, in respect of the physical parameter detected by the measuring sensor, predetermines the lower limit value in respect of the frequency at which the transmission values must be transmitted.

The time interval with which immediately successive measurement values are produced by the sensor must be so small that, in general, the change in the physical parameter, which occurs in that period of time, and thus the difference between two successively occurring measurement values, is smaller than or equal to the absolute amount of the incremental value. In accordance with a preferred alternative form of the process of the invention however the incremental value can be selected to be variable in such a way that, with high rates of change, a greater difference is associated with the incremental value represented by a respective bit, than when the rates of change are low.

In other words: at high rates of change, at the receiver end the transmitted incremental values are no longer associated (added to or subtracted from) the place of the virtual measurement value extrapolated there, which place is of the lowest value, but it is associated with the place having the second lowest or even a still higher value. Admittedly, that results in a corresponding reduction in the resolution capability, but that generally does not represent a disadvantage having regard to such high rates of change of the physical parameter to be measured.

The upper limit frequency with which the transmission values are transmitted must be selected to be so high that, besides the pairs of bits which represent the incremental values and the sign of the transmission values belonging to the second category, it is also possible to transmit the items of 'additional information ' which includes the bits representing the transmission values in the first category and protocol data, by means of which the receiver can recognise the category to which the respective bit belongs, the magnitude which is to be attributed to an incremental step at the respective moment in time, and the length of the transmitted words in which bits in the first category, bits in the second category and protocol bits are contained in a predeterminable sequence and number.

So that the upper limit frequency remains so low that the technical expenditure required for operation of the procedure does not become excessively high, on the one hand the number of items of additional information must be kept low and on the other hand the mathematically produced correction values must result in a steady synthetic measurement value so that a complete absolute value can be transmitted within the time in which such a correction value occurs.

It may be noted at this point that German laid-open application (DE-OS) No 42 24 225 describes an electronic evaluation arrangement for a position sensor, that arrangement ascertaining the measurement values involved, by means of a control loop. In that situation the measurement value which is made available in digital form always trails behind the actual (angular) position when the latter changes. The circuit arrangement is so designed however that, when that change takes place at a constant speed, a correction value is formed in order to compensate for the above-mentioned lag error, and the correction value is so added to the instantaneous measurement value that the corrected measurement value exactly reproduces the instantaneous actual position.

If the process according to the invention is applied to the transmission of the measurement values of that sensor system, the incremental values are derived from the uncorrected measurement values and the measurement values which involve the lag error correction are associated with transmission values in the first category. That means that, whenever a change in the lag error correction value occurs, a complete absolute value must be transmitted. Because of the extremely great inertia of mechanical systems, such as for example a rotating shaft, in comparison with the speed of electronic measuring and transmission procedures, the amount of data occurring in such a case is to be readily managed when using the process according to the invention, with a transmission frequency in the range of from some 100 kHz to some MHz.

It is then sufficient for transmission purposes to use a twisted two-wire line which is coupled on each side by way of a transformer so that the measurement values occurring at the transmitter end can be simulated in virtual fozm at the receiver end in real time.

In principle, in the case of systems which do not involve any changes in correction values which are not embraced by the increment-forming operation, it would be possible to transmit only a single absolute value and to extrapolate the virtual measurement values at the receiver end, on the basis of that single absolute value, by means of the transmitted incremental values. Preferably however, even in such cases, transmission values in the first category are repeatedly transmitted at predeterminable time intervals. That offers the receiving end the possibility of recognising and correcting errors by the comparison of such a complete transmitted absolute value with the virtual measurement value extrapolated thereby, while in most cases by means of simple plausibility criteria it is possible to ascertain whether a detected deviation originates from a fault which has occurred during the transmission of the absolute value or whether the extrapolated value is defective. That consideration also applies in the situation where a deviation has occurred because the sensor was operated outside the defined limit values.

There is no need for the bits which represent a complete transmission value in the first category to be sent in immediate succession. On the contrary, preferably the procedure is such that said bits are transmitted in a group-wise manner or individually, interlaced with bits which represent the incremental alterations. Thus, when the system is switched on, a few microseconds are admittedly required until the receiver has a first complete measurement value, on the basis of which it is possible to infer the measurement values which have occurred hitherto, and the following virtual measurement values can be extrapolated; that period of time however is shorter than the regular start-up time which such systems require in any case.

The protocol data can also be transmitted interlaced with the bits representing the incremental values in such a way that gap-free extrapolation of the virtual measurement values is possible at the receiver end.

In a particularly advantageous transmission process, provided between the transmitter and the receiver is a suitable twisted two-wire line on which a standing ac voltage wave is produced, the wave being of the transmission frequency which is established in accordance with the above-discussed criteria and being of a fixed voltage amplitude. Both the electrical energy required therefor and also the electrical energy required to power the sensor and its electronic system can be fed in from the receiver end. For information transmission purposes the standing wave is current-modulated, and that can be effected by opening and closing a fast controllable switch arrangement at the transmitter. With two successive half-waves (one positive and one negative), it is then possible to represent four different states (first half-wave loaded or unloaded; second half-wave loaded or unloaded); of those states for example only three are required for the transmission of an incremental value (with sign). The fourth state can then be used for error detection or it can be used to identify the subsequent data as protocol data.

It will be seen from the foregoing description that, for example when the measurement values to be transmitted occur at the transmitter end at a mean rate of 1 MHz and a transmission frequency of 2 MHz is selected, then the process according to the invention provides that the measurement values can be virtually simulated at the receiver end practically in real time and 50% of the time are always still available for transmitting 'additional data' such as measurement values in the first category and items of protocol information. In that respect fluctuations in the frequency at which the measurement values are supplied by the sensor play no part, as long as they are not excessively great. This is a further crucial advantage of the process according to the invention, over parallel transmission processes, as the latter have to contend with transit time problems if the rate of the measurement values fluctuates. In addition a twisted two-wire line is substantially easier to handle and much less susceptible to trouble than twelve or more parallel lines on which a correspondingly large number of bits is to be simultaneously transmitted at high speed.

So that, in the case of the systems which at the transmitter end produce mathematical correction values which are not included by the incremental values, a complete absolute value does not have to be transmitted every time that the correction value changes, a preferred variant provides that virtual measurement values are also formed at the transmitter end and those values are continuously compared to the absolute measurement values which occur there. If a deviation is detected in that comparison operation, the transmitter can form appropriate correction increments and send them as transmission values in the second category.

Further preferred features of the invention are set forth in the accompanying claims.

Further objects, features and advantages of the present invention will be apparent from the following description of a preferred embodiment of the process according to the invention and a transmission arrangement for carrying the process into effect.

BRIEF DESCRIPTION OF THE DRAWING

The single FIGURE is a highly diagrammatic view of a transmission arrangement for carrying into effect the process according to the invention.

DESCRIPTION OF THE PREFERRED EMBODIMENT

The FIGURE of the drawing diagrammatically shows a transmitter 1 in which data to be transmitted continuously occur in digital form, and a receiver end 2 to which those data are to be transmitted for further processing. The communication between the transmitter 1 and the receiver 2 is formed by a twisted 2-wire line 4.

The 2-wire line 4 serves on the one hand to transmit from the receiver side 2 to the transmitter 1 the electrical energy which is required for operation of the circuit arrangements included in the transmitter 1. At the same time however it also serves for transmission of the data made available by the transmitter 1 to the user of such data, which is disposed at the receiver end 2. The expressions 'transmitter' and 'receiver' therefore refer to the direction of flow of the measurement data to be transmitted, while electrical supply energy and if desired control commands are transmitted on the 2-wire line 4 in the opposite direction, that is to say from the receiver 2 to the transmitter 1.

For the purposes of the description hereinafter it is assured that disposed at the side with the transmitter 1 is a measuring sensor which detects and measures some physical parameter and converts it into an electrical signal. For example the sensor may be a temperature sensor, a position sensor such as for example a rotary sensing device, and the like. Furthermore, disposed at the transmitter end is an electronic preparation and intermediate storage circuit which processes the electrical signal supplied by the sensor and prepares it to be called up or to be available in digital form for transmission to the receiver end 2. A sensor of that kind and associated electronic circuits are to be found for example in the published specification of European patent application No 93 111319.5. In the present context that sensor together with its complete electronic assembly is referred to for the sake of brevity as the 'consumer' which is shown in the FIGURE by the block identified by reference numeral 6.

It will be appreciated that the receiver end 2 includes an electronic evaluation system which in the present context is referred to as a 'user' and which provides for further processing of the data supplied by the transmitter 1, a current supply unit which makes the electrical energy required by the transmitter 1 available in suitable form, and also further circuit arrangements which are briefly described hereinafter but which are not illustrated in the FIGURE as the structure thereof and their mutual interconnection are self-evident to those skilled in this art and therefore do not need to be described.

The only important consideration in this respect is that the electrical energy which is required for operation of the transmitter 1 and which is produced by the above-mentioned energy supply circuit is fed into the system in the form of a high-frequency ac voltage at the connecting terminals 8, 9 at which the data coming from the transmitter 1 can also be taken off.

As can be seen from the FIGURE the connecting terminals 8, 9 are connected to the one winding 10 of a transformer 11 whose other winding 12 is connected to the end of the 2-wire line 4, being the end towards the receiver 2. The terms 'primary winding' and 'secondary winding' have deliberately not been employed here became the winding 10 forms the primary side of the transformer in regard to the electrical supply energy to be transmitted, but it forms the secondary side of the transformer 11 in regard to the data to be transmitted from the transmitter 1 to the receiver end 2. A corresponding configuration applies in reverse in regard to the winding 12.

The windings 10 and 12 of the transformer 11 are so designed that the ac voltage which is supplied at the terminals 8 and 9 and which serves to power the transmitter 1 is transformed in a step-down mode in order to minimize the losses which occur due to high-frequency transverse or leakance currents, on the 2-wire line 4.

In order again to have a sufficiently high ac voltage at the transmitter end 1, the corresponding end of the 2-wire line 4 is terminated with the one winding 14 of a second transformer 15 whose other winding 16 produces at the teals 18 and 19 the ac voltage which is required for powering the transmitter 1 and which has been stepped up again. In addition to that voltage transformation procedure the transformers 11 and 14 also perform further important and highly advantageous functions which will be described in greater detail hereinafter.

As can also be seen from the FIGURE one side of the consumer 6 is connected directly to the terminal 19 while its other side is connected to the terminal 18 by way of a resistor 21 with which a fast controllable switch 22 is connected in parallel.

Connected in parallel with the series circuit comprising the resistor 21 and the consumer 6, across the terminals 18 and 19, is a further series circuit, which comprises a resistor 24 and a fast controllable switch 25. The above-mentioned resistors 21, 24 and switches 22, 25 which are provided in addition to the consumer 6 serve to impress the data supplied by the consumer in digital form on to the 2-wire transmission line 4, by current modulation, and to transmit such data to the user which is disposed at the receiver end 2, as will be described in greater detail hereinafter. The control circuit for actuating the switches 22 and 25 for effecting that current modulation effect is included in the consumer 6 and is not described herein as the structure and mode of operation thereof are readily familiar to a man skilled in this art.

It should firstly be noted at this point that an important consideration in regard to the described transmission arrangement is for the transmitter 1 and the receiver 2 to be connected by means of a line which is of minimum possible cost. In order to prevent interference signals from being picked up, a twisted 2-wire line is therefore selected, although the requirements made in respect of the high-frequency properties thereof cannot be at a high level so that in particular a low degree of characteristic wave impedance and a low degree of transverse or leakance resistance must be tolerated. In order nonetheless to minimize the leakance current, as already mentioned above, the transformers 11 and 15 are so designed that the voltage between the two wires of the 2-wire line 4 is substantially lower than the supply voltage required by the consumer 6.

In order to ensure initial transient-free data transmission, for example by binary current modulation, the procedure involved provides that a standing ac voltage wave is formed on the 2-wire line 4, from the receiver 2, at least for one binary state; that wave has an antinode at the input of the transmitter 1. In order to achieve that, it is necessary for the length of the 2-wire line 4 to be equal to $\lambda/4$ or an odd multiple thereof when $\lambda$ is the wavelength of the ac voltage wave. Preferably, the frequency of the ac supply voltage which is supplied at the terminals 8 and 9 and the length of the 2-wire line 4 are so matched to each other that the latter is equal to a quarter of $\lambda$ because that affords the lowest possible frequency of the ac supply voltage.

As the length and/or the relative dielectric constant $\eta_r$ of the 2-wire line 4 may be of different values from one situation of use to another, provided at the receiver end 2 is a circuit arrangement (not shown) which, at least when the system is first brought into operation, feeds a short pulse into the 2-wire line 4 by way of the terminals 8 and 9 and the transformer 11, and, on the basis of the transit time $\tau$ which that pulse requires to go to the transmitter 1 and, after reflection thereof there, back to the receiver 2 again, ascertains the appropriate frequency f for $\lambda/4$ from $$f=\frac{1}{2\tau}$$

The presence of an antinode of the standing ac voltage wave which is fed into the 2-wire line 4, at the input of the transmitter 1, is one of the necessary requirements to provide that changes in load which are effected at the transmitter end for the purposes of current modulation exhibit a maximum reaction, on the part of the receiver 1. A further condition for this is that the terminating resistances between which the system switches to and fro to produce those changes in load result in a change, which is as advantageous as possible, in the reflection factor which is operative at the transmitter input. In order to achieve that, for the purposes of current modulation the arrangement provides for switching to and fro between a first modulation state in which the 2-wire line 4 is terminated by the resistance which provides for ideal power matching, and a second modulation state in which a resistance that is markedly greater than the above-mentioned resistance terminates the 2-wire line 4 and thus detunes it.

Without the transformer 15 the resistance which terminates the 2-wire line 4 for the purposes of ideal power matching would be equal to its characteristic wave impedance $\zeta_L$. As the transformer 15 raises that value by the square of its transformation ratio n, the resistance $n^2.\zeta_L$ must appear between the terminals 18 and 19 for ideal power matching.

If the arrangement is switched over from that first modulation state into a second modulation state in which a substantially higher resistance, for example $3.n^2.\zeta_L$ is operative between the terminals 18 and 19, the voltage available between those terminals 18 and 19 correspondingly rises.

It is admittedly possible in principle to derive a constant supply voltage for the consumer 6 from that varying terminal voltage, by means of one of the generally conventional circuit arrangements for that purpose. However, a particularly simple procedure for making a constant supply voltage available provides that the consumer 6 in the first modulation state is supplied directly with the voltage available at the terminals 18 and 19 while in the second modulation state it is connected as the second member of a voltage divider to the terminals 18 and 19 by way of a series resistor 21 which reduces the increased voltage to such a degree that the voltage reining at the consumer 6 remains unchanged in comparison with the first modulation state. That procedure is effected by means of the fast controllable switch 22 which is connected in parallel with the resistor 21 and which, in the first modulation state, is closed and thus rends the resistor 21 ineffective or provides that the consumer 6 is directly connected to the voltage across the terminals 18 and 19.

In the second modulation state on the other hand the switch 22 is open so that the consumer 6, with the resistor 21, forms a voltage divider which reduces the increased voltage at the terminals 18 and 19 so that the voltage at the consumer 6 remains unchanged in comparison with the first modulation state.

In order to permit that, the resistance values of the consumer 6 on the one hand and the resistor 21 on the other hand must be suitably selected. That is preferably such that the resistance of the consumer 6 is equal to $2.n^2.\zeta_L$. That can be effected for example by means of suitable non-switchable series or parallel resistors which are not shown in the FIGURE. Another possible way of achieving this is for the transformation ratio n of the transformer 15 to be so selected that the resistance of the consumer 6, which is fixedly predetermined in terms of circuitry, is equal to $2.n^2.\zeta_L$.

In order nonetheless in the first modulation state to be able to terminate the 2-wire line 4 with the characteristic wave impedance which results in ideal power matching, the arrangement includes the above-mentioned resistor 22 whose resistance is equal to that of the consumer 6, being therefore equal to $2.n^2.\zeta_L$. As the switch 25 which is connected in series with the resistor 22 is closed in the first modulation state, there is a total resistance $n^2.\zeta_L$ for line termination purposes. The switch 25 is open in the second modulation state so that the 2-wire line 4 is terminated with the total resistance $3.n^2.\zeta_L$ which is composed of the resistances of the resistor 21 and the consumer 6.

For the first modulation state therefore there is a reflection factor r=0, that is to say all the electrical energy which is fed into the 2-wire line 4 from the receiver end 2 can pass in a reflection-free manner into the transmitter 1 and can serve there to provide the power supply. In the second modulation state there is a reflection factor r=0.5, and this, in comparison with the first modulation state, results in an increase by 50% in the voltage at the terminals 18 and 19. As the voltage divider formed by the resistor 21 and the consumer 6 divides that increased voltage in the ratio of 1:2, with two thirds being dropped at the consumer 6, the supply voltage remains unchanged for the consumer when the arrangement switches over from one modulation state to the other. On the other hand a reflection factor r=0.5 is completely sufficient to produce an adequate reaction which permits satisfactory data transmission, at the input of the 2-wire transmission line 4, that is to say on the part of the receiver 2.

Besides the reduction in losses which occur in the transmission line 4, and the possibility of adapting the characteristic wave impedance of the 2-wire line 4 to the resistance value of the consumer 6, the two transformers 11 and 15 afford the advantage that both the transmitter 1 and also the receiver end 2 are galvanically completely separated from the 2-wire line 4 and can be in the form of Faraday cages, as is indicated by the broken lines identified by references 27 and 28.

Thus, excess voltages which are coupled into the 2-wire line 4 cannot pass either into the transmitter 1 or into the receiver 2. The arrangement may suffer at most a flash-over to the grounded casings so that damage may be caused only to the 2-wire line 4, but not to the electronic systems at the transmitter and/or receiver ends.

An essential requirement in this respect is that the transmitter 1 and the receiver 2 are only connected together by a single 2-wire line 4 which provides both for the supply of energy for the transmitter 1 and also the transmission of data from the transmitter 1 to the receiver 2.

If two such lines were to be provided, they and the transformers would have to be ideally matched to each other. As that is scarcely possible in a practical context, there would always be the risk that, in the event of excess voltages occurring, there would be differences in transit times on the two lines and short high voltage peaks could pass into the transmitter 1 or receiver 2 and damage the electronic systems therein.

It will be appreciated that the above-described process according to the invention and the arrangenent for carrying the process into effect have been set forth solely by way of example and illustration of the principles of the present invention and that various modifications and alterations may be made therein without thereby departing from the spirit and scope of the invention.

What is claimed is:

1. A method of transmitting measurement values from a measuring unit to a receiver unit said measuring unit comprising a sensor supplying an analog measurement signal, an analog/digital converter encoding said analog measurement signal into distinct digital measurement values with a sampling rate having a selectable value, and a transmitter sending digital signals representing said digital measurement values to said receiver unit, and said receiver unit comprising a decoder synthesising in a real time mode recovered measurement values from said transmitted digital signals so that said recovered measurement values correspond to the digital measurement values generated by said encoder in said measuring unit, wherein said method comprises the following steps:

selecting said value of said sampling rate such that the absolute value of the difference between two immediately successive digital measurement values cannot exceed a selected incremental amount, representing said difference and its sign by a two bit incremental alteration value as +1, −1 or 0, transmitting within a predeterminable period of time during which many digital measurement values are generated only one of these digital measurement values completely while of all the others only the respective incremental alteration value is transmitted, and within each of said predeterminable periods of time generating a first recovered measurement value by adding correctly with respect to sign to the completely transmitted measurement value the incremental alteration value representing the difference to the immediately successive digital measurement value and, thereafter, generating in said predetermined period of time all subsequent recovered measurement values by adding correctly with respect to sign the respective incremental alteration value to the immediately preceding recovered measurement value.

2. A method according to claim 1, wherein the bits of the measurement value which, within one period of time, is to be transmitted completely are transmitted alternately with bits representing incremental alteration values.

3. A method according to claim 1, wherein the bits of the measurement value which, within one period of time, is to be transmitted completely are transmitted in small groups alternately with bits representing incremental alteration values.

4. A method according to claim 2, wherein a plurality of incremental alteration values is transmitted between two successively transmitted bits of a measurement value which is completely to be transmitted.

5. A method according to claim 2, wherein a plurality of incremental alteration values is transmitted between two successively transmitted bit groups of a measurement value which is completely to be transmitted.

6. A method according to claim 1, further comprising the step of transmitting protocol bits which permit a distinction between bits of an incremental alteration value and bits of a measurement value which is completely to be transmitted.

7. A method according to claim 1, wherein said selected incremental amount is selected differently at different times.

8. A method according to claim 7, wherein said incremental amount is defined by means of protocol bits to be transmitted.

9. A method according to claim 1, further comprising the step of comparing a freshly completely transmitted digital measurement value to the last recovered measurement value in the receiver unit and to use any difference occuring for error detection and error correction.

10. A method according to claim 1, further comprising the step of forming recovered measurement values also in the measuring unit and of comparing them to the respective digital measurement values, and of forming correction increments in case that differences occur between said recovered measurement values in the measuring unit and said respective digital measurement values, which correction increments are also transmitted to said receiver unit.

11. A method according to claim 1, further comprising the step that the transmission is effected on a 2-wire line on to which is impressed a standing ac voltage wave with invariable voltage amplitude, whose frequency is so tuned to the 2-wire line that the length thereof is equal to a quarter or an odd-numbered multiple of a quarter of the ac voltage wave length (λ), and wherein the encoding of the individual bits to be transmitted is effected by current modulation in such a way that at the transmitter end a controllable switch arrangement provides for switching to and fro between a first modulation state in which the 2-wire line is terminated with a first resistance, and a second modulation state in which the 2-wire line is terminated by a second resistance which is different from the first resistance.

12. A method according to claim 11, wherein the standing ac voltage wave is impressed on to the 2-wire line by the receiver unit and serves at the same time for the current supply for the circuit arrangement in the measuring unit.

13. A method according to claim 11, wherein the resistance value to which the system is switched over in the first modulation state is the resistance which is required for ideal power matching of the transmitter end to the 2-wire line.

14. A method according to claim 11, wherein the resistance to which the system is switched over in the second modulation state is equal to three times the resistance used for the first modulation state.

15. A method according to claim 14, further comprising the step that the 2-wire line and a consumer in the measuring unit are so matched to each other that the resistance of the consumer is equal to twice the resistance required for ideal power matching, wherein connected in series with the consumer is a first resistor whose resistance is equal to the resistance required for ideal power matching and which can be short-circuited by a parallel-connected, first controllable switch, and wherein provided in parallel with the series circuit comprising the consumer and the first resistor is a further series circuit comprising a second controllable switch and a second resistor whose resistance is equal to twice the resistance required for ideal power matching.

16. A method according to claim 15, wherein matching between the 2-wire line and the consumer at the transmitter end is effected by means of a transformer connected between the end of the line and the input of the transmitter.

17. A method according to claim 16, wherein the 2-wire line is also coupled to the receiver unit by means of a transformer.

18. A method according to claim 16, wherein the transmitter is proteced as a Faraday cage from externally originating extraneous voltages.

19. A method according to claim 16, wherein the receiver unit is proteced as a Faraday cage from externally originating extraneous voltages.

20. A method acoording to claim 8, wherein provided in the receiver unit is a circuit arrangement which, when the system is switched on, measures the length of the 2-wire line and adapts the frequency of the ac voltage supplied by the receiver to the 2-wire line.

* * * * *